United States Patent [19]

Broughton et al.

[11] Patent Number: 4,525,149

[45] Date of Patent: Jun. 25, 1985

[54] MARINE PROPULSION DEVICE INCLUDING IGNITION INTERRUPTION MEANS TO ASSIST TRANSMISSION SHIFTING

[75] Inventors: George L. Broughton; Jeffrey P. Higby, both of Waukegan, Ill.; Robert F. Young, Kenosha, Wis.

[73] Assignee: Outboard Marine Corporation, Waukegan, Ill.

[21] Appl. No.: 369,072

[22] Filed: Apr. 16, 1982

[51] Int. Cl.[3] ..... B63H 5/06

[52] U.S. Cl. ..... 440/1; 440/75; 440/86; 74/851; 74/852

[58] Field of Search ..... 440/1, 75, 84, 86; 74/470, 843, 845, 851, 852, 872, 874, 879, 858, 860; 192/0.084

[56] References Cited

U.S. PATENT DOCUMENTS

| | | | |
|---|---|---|---|
| 2,519,080 | 8/1950 | Simpson | 74/718 |
| 2,927,676 | 10/1942 | Elkin | 400/134.2 |
| 3,910,388 | 10/1975 | Moori et al. | 192/3.56 |
| 4,072,204 | 2/1978 | Leighton et al. | 180/205 |
| 4,215,596 | 8/1980 | Long | 74/851 |
| 4,262,622 | 4/1981 | Dretzka et al. | 440/86 |

*Primary Examiner*—Trygve M. Blix
*Assistant Examiner*—Edwin L. Swinehart
*Attorney, Agent, or Firm*—Michael, Best & Friedrich

[57] ABSTRACT

Shifting of a marine propulsion device transmission drivingly connecting a drive shaft to an internal combustion engine and including a rotatable member operable to shift the transmission between forward drive, reverse drive and neutral positions in response to rotation of a shift lever is assisted by a shift assistance arrangement including a pivotal actuation lever connected to a push-pull assembly operated by a main control and a connecting link pivotally connected to the shift lever and to the actuator lever. The pivotal connection between the connecting link and the actuation lever includes a slider element mounted for reciprocative axial movement relative to the connecting link and pivotally receiving a pivot pin on the actuation lever. A pair of springs acting on the opposite ends of the slider element maintain the connecting link and the actuation lever in a normal position so they move together to effect shifting when the resistance to transmission shift is below a predetermined level. The slider element, and thus the actuation lever, is displaced relative to the connecting link from the normal position when the shift resistance is above that level. The shift arrangement also includes a switch which is carried by the actuation lever and is engaged to interrupt engine ignition by a pair of cams on the connecting link when the actuation lever is displaced from the normal position only during shifting from either the forward drive position or the reverse drive position to the neutral position.

7 Claims, 7 Drawing Figures

MARINE PROPULSION DEVICE INCLUDING IGNITION INTERRUPTION MEANS TO ASSIST TRANSMISSION SHIFTING

BACKGROUND OF THE INVENTION

This invention relates to marine propulsion devices, such as stern drive units and outboard motors, including a reversing transmission and a shifting mechanism therefor and, more particularly, to marine propulsion devices including means to assist transmission shifting.

Marine propulsion devices such as outboard motors and stern drive units commonly employ reversing clutches or transmissions which connect the output shaft of an engine to the propeller shaft to provide forward drive, reverse drive and neutral operations. Such transmissions frequently include a pair of opposed, axially spaced drive gears and a clutch dog which is splined to the propeller shaft and can be selectively shifted axially into engagement with the drive gears. The shiftable clutch dog has driving lugs which engage complementary driving lugs on the drive gears.

Relatively high shift load can be experienced when attempting to shift the transmission from either forward drive or reverse drive to neutral. The torque exerted on the clutch dog lugs by a drive gear creates a resistance to movement of the clutch dog from an "in gear" position to neutral. Shifting can be facilitated by momentarily interrupting engine operation and thereby minimizing this torque.

Attention is directed to the following United States patents:

| Patentee | U.S. Pat. No. | Issue Date |
|---|---|---|
| Elkin | 2,297,676 | October 6, 1942 |
| Moori et al | 3,910,388 | October 7, 1975 |
| Leighton et al | 4,072,204 | February 7, 1978 |
| Long | 4,215,596 | August 5, 1980 |
| Dretzka et al | 4,262,622 | April 21, 1981 |

Attention is also directed to corresponding application Ser. No. 338,304, filed Jan. 11, 1982, now U.S. Pat. No. 4,432,734, issued Feb. 21, 1984, and assigned to the assignee of the present application.

Some of these arrangements employ two or more electrical switches, others interrupt engine ignition any time the shift resistance exceeds a predetermined value during shifting into gear and out of gear, and others interrupt ignition only during shifting into gear.

SUMMARY OF THE INVENTION

The invention provides an arrangement for assisting shifting of a transmission in a marime propulsion device including an internal combustion engine driving a drive shaft, a transmission drivingly connecting the drive shaft with a propeller shaft and shiftable between drive and neutral positions, and shift means including a movable first member or shift lever for shifting the transmission between a drive and neutral positions in response to movement of the shift lever. The shift assistance arrangement includes a second member or actuation lever movable in response to actuation by an operator to effect shifting, a third member or connecting link connected to the shift lever and connected to the actuation lever for common movement therewith and for movement relative to the actuation lever when shift resistance is greater than a predetermined level, and means for interrupting engine ignition in response to movement of the actuation lever relative to the connecting link only when the actuation lever is actuated by an operator to shift the transmission from a drive position to the neutral position and the shift resistance is above the predetermined level.

The invention also provides a marine propulsion device including an internal combustion engine, a propulsion unit, a propeller shaft rotatably mounted in the propulsion unit and carrying a propeller, a drive shaft driven by the internal combustion engine and including a drive gear, a transmission including first and second bevel gears rotatably mounted on the propeller shaft and in meshing engagement with the drive gear and also including clutch dog means mounted on the propeller shaft for common rotation therewith and for reciprocal axial movement between a neutral position wherein the clutch dog means is out of engagement with both the bevel gears, a forward drive position wherein the clutch dog means is in meshing engagement with the first bevel gear, and a reverse drive position wherein the clutch dog means is in meshing engagement with the second bevel gear, shift means including a first member or shift lever operably connected to the clutch dog means for moving the clutch dog means axially between the forward drive, reverse drive and neutral positions in response to movement of the shift lever, and shift assistance means including a second member or actuation lever adapted for movement by an operator to effect shifting and a third member or connecting link connected to the shift lever and to the actuation lever for common movement therewith and for movement of the actuation lever relative to the connecting link when the shift resistance is greater than a predetermined level and means for interrupting engine ignition in response to movement of the actuation lever relative to the connecting link only when the actuation lever is actuated by an operator to shift the transmission from either the forward drive position or the reverse drive position to the neutral position and the shift resistance is above the predetermined level.

In one embodiment, the shift assistance arrangement includes biasing means for retaining the second member or actuation lever in a normal position relative to the third member or connecting link when the actuation lever is moved in response to a force applied thereon by an operator control and the shift resistance is below the predetermined level and for permitting displacement of the actuation lever relative to the connecting link from the normal position when the shift resistance exceeds the predetermined level. In addition, the ignition interruption means is operable to selectively interrupt engine ignition in response to the displacement of the actuation lever from the normal position only during shifting from a drive position to the neutral position.

In one embodiment, the interruption means includes a switch carried by the actuation lever and operable when engaged to selectively interrupt engine ignition and further includes a pair of cam means carried by the connecting link for common movement therewith. The cams are located relative to the switch so that one engages the switch only in response to relative displacement of the connecting link and the actuation lever from the normal position during shifting from the forward drive position to the neutral position and the other engages the switch only in response to relative displacement of the connecting link and the actuation lever from the normal position during shifting from the reverse drive position to the neutral position.

One of the principal features of the invention is the provision of a marine propulsion device including a transmission and means for momentarily interrupting engine ignition in the event the resistance to shifting the transmission from a drive position to neutral exceeds a predetermined level.

Another of the principal features of the invention is the provision of such a marine propulsion device including a reversing transmission and wherein the ignition interrupting means is operable only during shifting from forward or reverse drive to neutral.

A further of the principal features of the invention is the provision of such a marine propulsion device wherein the ignition interruption means includes only a single cam-actuated electrical switch.

Other features, aspects and advantages of the invention will become apparent to those skilled in the art upon reviewing the following detailed description, the drawings and the appended claims.

Figure 1:
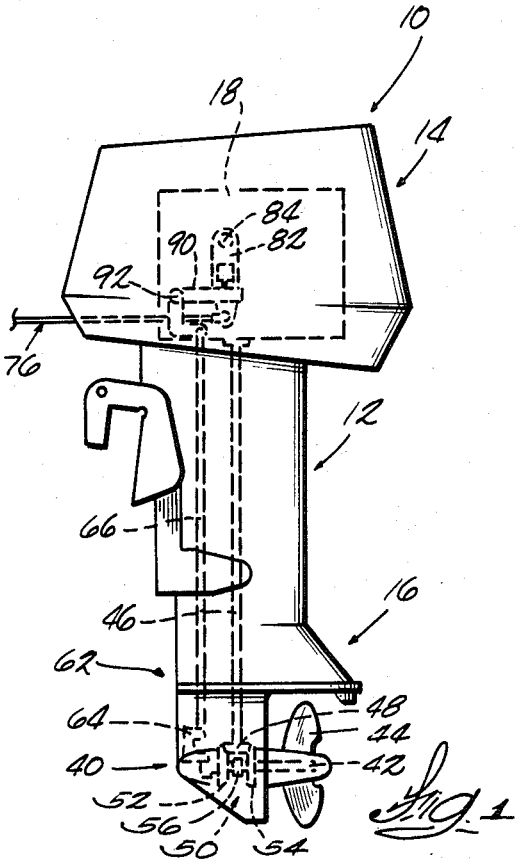
FIG. 1 is a side elevational view, of an outboard motor embodying various features of the invention.

Before explaining at least one of the embodiments of the invention in detail, it is to be understood that the invention is not limited in its application to the details of construction and the arrangements of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

The invention will be described for use in an outboard motor. However, it can be adapted for use in a stern drive unit and other marine propulsion devices.

Figure 2:
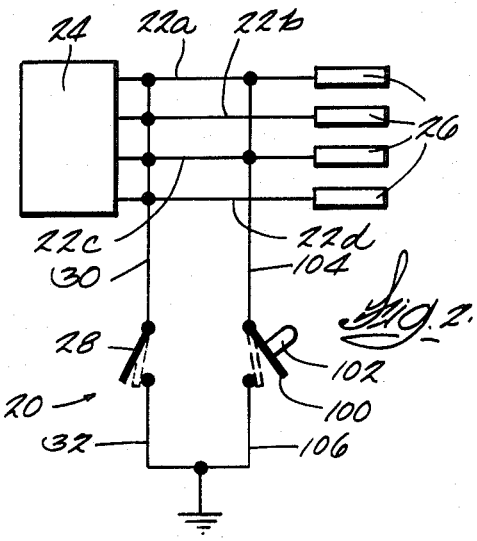
FIG. 2 is a diagrammatic representation of the ignition interruption circuit included in the outboard motor shown in FIG. 1.

Illustrated in FIG. 1 is an outboard motor 10 having a propulsion unit 12 including a power head 14 and a lower unit 16. The power head 14 includes a conventional internal combustion engine 18 having one or more (e.g., 4) cylinders (not shown) and a suitable ignition system 20 shown diagrammatically in FIG. 2.

The engine ignition circuit 20 includes electrical leads **22*a*, 22*b*, 22*c*, and 22*d* connecting an electrical power supply 24, such as a flywheel magneto, to a spark plug 26 for each engine cylinder and an on-off ignition switch 28 connected between the supply leads 22*a*, 22*b*, 22*c*, and 22*d* and the engine ground via electrical leads 30 and 32. The ignition switch 28 is movable between an "on" or engine operating position (illustrated by the solid lines in FIG. 2) to permit flow of electrical current to the spark plugs 26 and an "off" or engine shutdown position (illustrated by the dashed lines in FIG. 2) to ground or short out the power supply 24 via leads 30 and 32, thereby interrupting current flow to the engine spark plugs 26**.

The lower unit 16 (FIGS. 1 and 3) includes a gearcase 40 which is normally under water. Rotatably mounted in the gearcase 40 is a propeller shaft 42 carrying a propeller 44. Extending through the lower unit 16 transversely of the propeller shaft 42 is a rotatably mounted drive shaft 46 which is operably connected at the upper end to the engine 18 and carries a bevel drive gear 48 on the lower end.

The drive shaft 46 is drivingly connected to the propeller shaft 42 through a conventional reversing clutch or transmission 50. The transmission 50 includes a pair of axially spaced bevel gears 52 and 54 which are mounted for rotation coaxially with and independently of the propeller shaft 42 and which mesh with the drive gear 48. The transmission 50 also includes a shiftable clutch dog 56 which is carried on the propeller shaft 42 between the bevel gears 52 and 54 and includes (FIG. 3) one or more drive lugs 58 on the opposite end faces.

Figure 3:
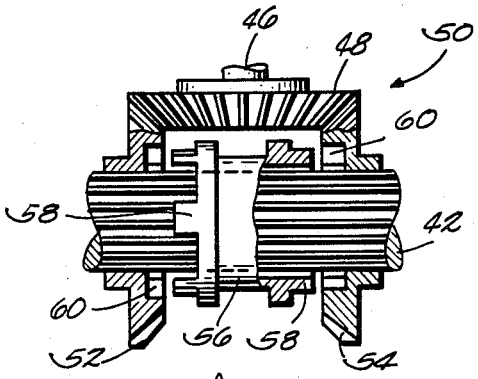
FIG. 3 is an enlarged, partially sectioned view of the transmission included in the outboard motor shown in FIG. 1.

As best shown in FIG. 3, the clutch dog 56 is splined on the propeller shaft 42 for common rotation therewith and for relative axial movement between a central or neutral position out of engagement with the bevel gears 52 and 54, a forward drive position (to the left of the neutral position shown in FIG. 3) wherein the drive lugs 58 on the left end face of the clutch dog 56 are engaged with complementary drive lugs 60 on the bevel gear 52, and a reverse drive position (to the right of the neutral position shown in FIG. 3) wherein the drive lugs 58 on the right end face of the clutch dog 56 engage complementary drive lugs 60 on the bevel gear 54. Thus, when the clutch dog drive lugs 58 are selectively fully engaged with the complementary drive lugs 60 on the bevel gears 52 and 54, the propeller shaft 42 is driven in the forward drive condition and the reverse drive condition, respectively. When the clutch dog 56 is in the neutral position disengaged from both the bevel gears 52 and 54, the propeller shaft 42 is not rotated because the bevel gears 52 and 54 rotate independently of the propeller shaft 42.

The clutch dog 56 is moved axially between the neutral, forward drive and reverse drive positions by a conventional lower shift mechanism, generally designated 62, including a shift actuator 64 operatively connected to the clutch dog 56 for common axial movement therewith while affording rotation of the propeller shaft 42 and the clutch dog 56 relative to the shift actuator 64. The shift mechanism 62 also includes a control or actuating rod 66 supported in the propulsion unit 12 for reciprocal movement transversely of the propeller shaft 42. The lower end of the actuating rod 66 is operably connected to the shift actuator 64 to effect axial movement of the shift actuator 64 and the clutch dog 56 relative to the propeller shaft 42 in response to movement of the actuating rod 66 transversely of the propeller shaft 42.

The upper end of the actuating rod 66 is pivotally connected to one leg 68 of a shift lever 70 pivotally mounted at 72. Rotation or rocking movement of the shift lever 70 effects reciprocal movement of the actuating rod 66 to shift the transmission 62 between forward drive, reverse drive and neutral positions. The other leg 74 of the shift lever 70 is connected to a main control lever (not shown) via a push-pull control cable assembly 76 and a shift assist arrangement, generally designated 80. The shift lever 70 rotates in opposite directions from a neutral position in response to back and forth movement of the push-pull cable assembly 76 resulting from operation of the main control lever by the operator as explained in more detail below.

Relatively high shift loads can be experienced when attempting to shift the transmission 50 from either the forward drive or the reverse drive position to the neutral position at speeds higher than idle speed. Such loads are the result of torque exerted on the clutch dog drive lugs 58 by the drive lugs 60 on the bevel gears 52 and 54, creating a resistance to axial movement of the clutch dog 56 from an "in gear" position to the neutral position. The shift assist arrangement 80 is operable to momentarily interrupt ignition of a number of the engine cylinders in response to movement of the main control lever by an operator from either the forward drive position or the reverse drive position to the neutral position when the shift resistance exceeds a predetermined level, thereby reducing the above-described torque and facilitating easier axial movement of the clutch dog from an "in gear" position to the neutral position.

More particularly, the shift assist arrangement 80 includes an actuation lever 82 to which the push-pull cable 76 is connected and which is pivotally mounted on a boss 84 on the exterior of the engine crank case 86 for rocking movement in response to back and forth movement of the push-pull cable 76. The shift lever 70 is connected to the actuation lever 82 by a pair of links 88 and 90 which at one end are pivotally connected to the shift lever 70 by a pin 92 or the like and at the other end are connected to the actuation lever 82 by a pivot means 94. The pivot means 94 is operable to permit the actuation lever 82 and the connecting links 88 and 90 to move together in response to movement of the push-pull cable 76 and to permit movement of the actuation lever 82 relative to the connecting links 88 and 90 from a normal position when a force greater than the predetermined level must be applied on the shift lever 70 to shift the clutch dog 56 from either the forward drive position or the reverse drive position to the neutral position.

The shift assist arrangement 80 also includes an electrical switch 100 affixed on the actuation lever 82 and having a plunger or actuator 102 which is actuated to close the switch 100 when the actuator lever 82 is displaced relative to the connecting links 88 and 90 from the normal position only during shifting from the forward drive position or the reverse drive position to the neutral position. The switch 100 (FIG. 2) is connected to half the supply leads, i.e., leads 22*a* and 22*c*, via an electrical lead 104. When the switch actuator 102 is not engaged, the switch 100 is open as illustrated by the solid lines and engine ignition continues in a normal manner. When the switch actuator 102 is engaged and actuated, the switch 100 closes as illustrated by the dashed lines and the leads 22*a* and 22*c* are shorted out to ground via electrical lead 106 thereby interrupting current flow to the respective engine spark plugs 26.

The switch 100 can be connected to fewer or more (even all) of the supply leads 22*a*, 22*b*, 22*c* and 22*d*, if desired. Also, the switch 100 can be normally closed and the electrical circuit arranged so that the switch is opened when the actuator 102 is engaged to interrupt engine ignition.

The pivot means 94 includes pins 106 and 108 extending outwardly from the opposite sides of the actuator lever 82. One pin 108 extends through an elongated, axially extending slot (not shown) in the connecting link 88. The other pin 106 is pivotally received in a slider element 110 which is disposed in an elongated, axially extending slot 112 in the other connecting link 90 and is mounted for axial movement relative to the connecting link 90. The slider element 110 includes a pair of spring retainers 114 and 116 on the opposite ends and is held in a normal position centrally located in the slot 112 by a pair of compression springs 118 and 120. As viewed in FIG. 4, one end 122 of the spring 118 bears against the spring retainer 114 and the opposite end 124 bears against the left end 126 of the slot 112. One end 128 of the other spring 120 bears against the spring retainer 116 and the opposite end 130 bears against a threaded member 131 closing the right end of 132 of the slot 112.

The springs 118 and 120 impart a preload on the slider element 110 corresponding to a predetermined shift resistance and the actuation lever 82 and the connecting links 88 and 90 move together as though connected through a "solid" pivot when the force required to move the shift lever 70 to engage or disengage the transmission clutch dog 56 is below the predetermined level.

Located on the opposite sides of the switch actuator 102 is a pair of axially spaced cams 140 and 142 which are arranged to be engaged by the switch actuator 102 when the actuation lever 82 is displaced relative to the connecting links 88 and 90 from the normal position, but only during shifting from either the forward drive position or the reverse drive position to the neutral position. The cams 140 and 142 can be formed as part of the upper edge of the link 90, as illustrated, or provided as a separate component mounted for common movement with the connecting link 90.

Figure 4:
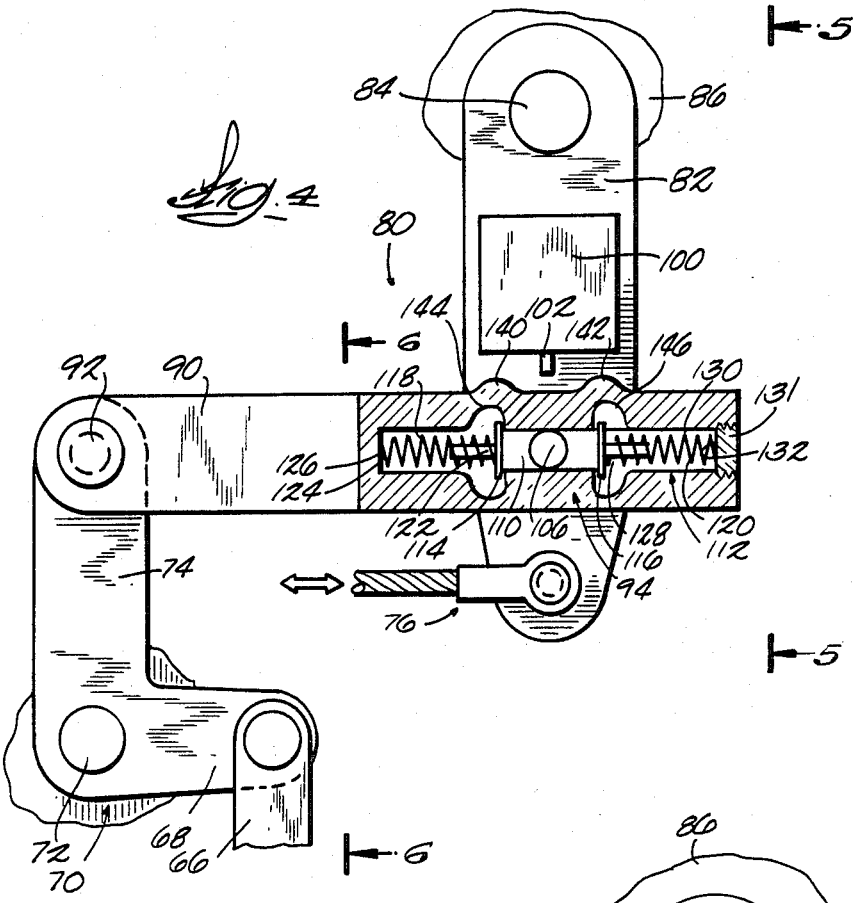
FIG. 4 is an enlarged, fragmentary, view of the shift assistance means included in the outboard motor shown in FIG. 1, showing the position of various components when the transmission is in the neutral position.
Figure 5:
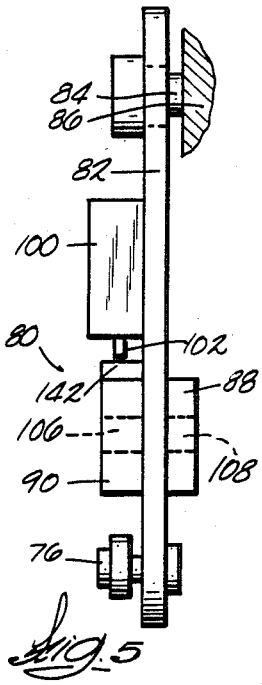
FIG. 5 is an end view taken generally along line 5—5 in FIG. 4.
Figure 6:
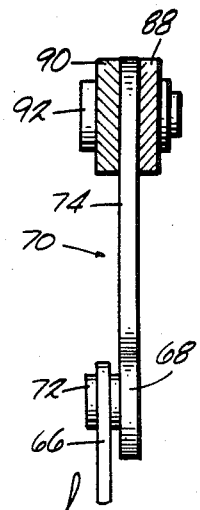
FIG. 6, is an end view taken generally along line 6—6 in FIG. 4.

Movement of the actuation lever 82 is rotational and movement of the connecting links 88 and 90 is essentially linear. The cams 140 and 142 and the switch actuator 102 are positioned so that they are closest to each other when the transmission is in the forward drive position as illustrated by the solid lines in FIG. 7 and the reverse drive position and are farthest apart when the transmission is in the neutral position as illustrated in FIG. 4. The slot 112 includes enlarged portions 144 and 146 which receive respective spring retainers 114 and 116. The enlarged portions 144 and 146 limit axial movement of the slider element 110, and thus movement of the actuation lever 82 relative to the connecting links 88 and 90. The enlarged portions 144 and 146 are arranged so that, even though one of the springs 118 and 120 is substantially compressed and the respective spring retainer is "bottomed out" during shifting from neutral to forward drive or reverse drive because of resistance to "in gear" shifting, the switch actuator 102 cannot engage the cams 140 and 142.

Figure 7:
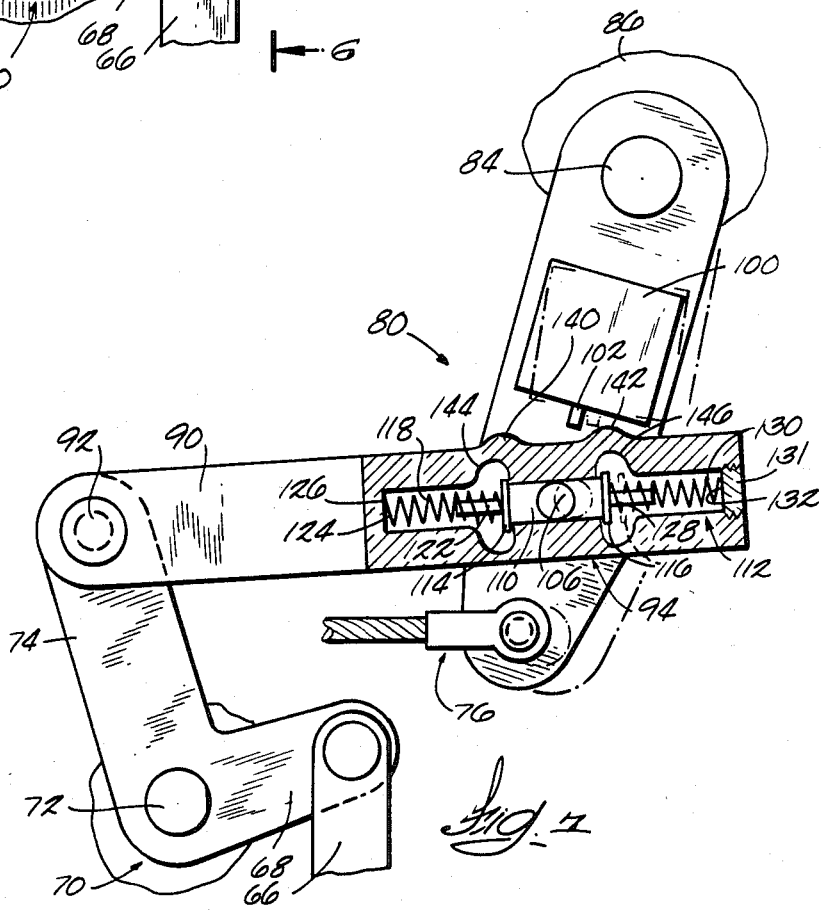
FIG. 7 is a view similar to FIG. 4 showing the position of various components when the transmission is in the forward drive position.

Once shifting to a drive position has been completed, the springs 118 and 120 retain the slider element 110 in the normal position. Referring to FIG. 7 illustrating the relative position of the components when the transmission is in the forward drive position, the operator can shift the transmission to neutral by operating the main control to move the actuation lever 82 to the right via the push-pull cable 76. If the shift resistance is below the predetermined level, the biasing force of the spring 120 retains the slider element 110 in the normal position, the actuation lever 82 and the connecting links 88 and 90 move together, and the shift lever 70 is rotated to the right to effect shifting.

If the shift resistance is in excess of the predetermined value, the biasing force of the spring 120 is overcome, permitting the slider element 110, and thus the pins 106 and 108 and the actuation lever 82, to move relative to the connecting links 88 and 90. When this occurs, the switch actuator 102 engages the cam 142 as illustrated by the dashed lines in FIG. 7 and the switch 100 closes to interrupt engine ignition to half the engine cylinders as described above. Once the transmission clutch dog 56 is disengaged from the bevel gear 54, the spring 120 returns the slider element 110, and thus the actuation lever 82, to the normal position, the switch actuator 102 deactuates, and the switch 100 returns to its normally open position to terminate interruption of engine ignition.

It can be appreciated that ignition interruption occurs in a similar manner during shifting of the transmission from the reverse drive position to the neutral position.

This arrangement permits over travel of the push-pull cable 76 in either direction in any shift position, but provides ignition interruption only when the force required to disengage the transmission clutch dog 56 is in excess of the biasing force of the springs 118 and 120.

Various of the features of the invention are set forth in the following claims:

We claim:

1. A marine propulsion device including an internal combustion engine, a propulsion unit, a propeller shaft rotatably mounted in said propulsion unit and carrying a propeller, a drive shaft rotatably mounted in said propulsion unit and driven by said internal combustion engine, a transmission drivingly connecting said drive shaft with said propeller shaft and shiftable between a drive position and a neutral position, a movable first member operably connected to said transmission for shifting thereof between a drive position and a neutral position in response to movement of said first member, a second member movable in response to shifting actuation by an operator, a third member connected to said first member, a fourth member connected to said second member for pivotal movement therebetween and connected to said third member for translatory movement therebetween from a reference position whereby to obtain translatory movement of said third member relative to said second member, means releasably holding said fourth member against movement relative to said third member and from the reference position in the absence of shift resistance greater than a predetermined value, and means for selectively interrupting engine ignition only in response to relative movement of said third and fourth members.

2. A marine propulsion device according to claim 1 wherein said drive shaft includes a drive gear, wherein said transmission includes first and second bevel gears rotatably mounted on said propeller shaft and in meshing engagement with said drive gear, and clutch dog means mounted on said propeller shaft for common rotation therewith and for reciprocal axial movement between the neutral position wherein said clutch dog means is out of engagement with both of the said bevel gears, a forward drive position wherein said clutch dog means is in meshing engagement with said first bevel gear, and a reverse drive position wherein said clutch dog means is in meshing engagement with said second bevel gear, wherein said first member is operable to axially move said clutch dog means between the forward drive, reverse drive, and neutral positions in response to movement of said first member, and wherein fourth member is translatorily movable relative to said third member in opposite directions on both sides of said reference position.

3. A marine propulsion device according to claim 2 wherein said first member comprises a rotatable shift lever operably connected to said transmission for shifting said transmission in response to rotation of said shift lever, and wherein said second member is mounted for pivotal movement is response to actuation by an operator.

4. A marine propulsion device according to claim 3 wherein said interruption means includes switch means carried by said second member for common movement therewith and operable when engaged to selectively interrupt the ignition of said engine, and further including first and second cam means carried by said third member for common movement therewith and located relative to said switch means such that said first cam means engages said switch means only in response to relative displacement of said second and third members during shifting from the forward drive position to the neutral position and such that said second cam means engages said switch means only in response to relative displacement of said second and third members during shifting from the reverse drive position to the neutral position.

5. A marine propulsion device according to claim 4 wherein a pivot pin is fixedly mounted on said second member, and said fourth member comprises an elongated slider element which has opposite ends, which is mounted for reciprocative axial movement relative to said third member and which pivotally receives said pivot pin, and wherein said holding means comprises a pair of springs acting on said opposite ends of said slider element to bias said slider element to said reference position when the shift resistance is below said predetermined level and to permit axial movement of said slider element relative to said third member in response to movement of said second member by an operator to effect shifting when the shift resistance is above said predetermined level.

6. A marine propulsion device according to claim 5 wherein said first and second cam means are an integral part of said third member and said third member includes an elongate, axially extending slot in which said slider element and said springs are disposed.

7. A marine propulsion device including an internal combustion engine, a propulsion unit, a propeller shaft rotatably mounted in said propulsion unit and carrying a propeller, a drive shaft rotatably mounted in said propulsion unit and driven by said internal combustion engine, a transmission drivingly connecting said drive shaft with said propeller shaft and shiftable between a drive position and a neutral position, shift means including a movable first member operably connected to said transmission for shifting thereof between a drive position and a neutral position in response to movement of said first member, a second member movable in response to shifting actuation by an operator, a third member connected to said first member, a fourth member connected to said second member for pivotal movement therebetween and connected to said third member for translatory movement therebetween from a reference position whereby to obtain translatory movement of said third member relative to said second member, means releasably holding said fourth member against movement relative to said third member and from the reference position in the absence of shift resistance greater than a predetermined value, and means for selectively interrupting engine ignition in response to relative movement between said second member and said third member when said second member is actuated by an operator to shift between the drive position and the neutral position and when the shift resistance is above the predetermined level.

* * * * *